US006075838A

United States Patent [19]

McGeoch

[11] Patent Number: 6,075,838

[45] Date of Patent: Jun. 13, 2000

[54] Z-PINCH SOFT X-RAY SOURCE USING DILUENT GAS

[75] Inventor: Malcolm W. McGeoch, Brookline, Mass.

[73] Assignee: PLEX LLC, Brookline, Mass.

[21] Appl. No.: 09/040,754

[22] Filed: Mar. 18, 1998

[51] Int. Cl.[7] ..... G21G 4/00

[52] U.S. Cl. ..... 378/119; 378/127

[58] Field of Search ..... 378/119, 122

[56] References Cited

U.S. PATENT DOCUMENTS

| | | | |
|---|---|---|---|
| 3,968,378 | 7/1976 | Roberts et al. | 250/502 |
| 5,504,795 | 4/1996 | McGeoch | 378/119 |
| 5,577,092 | 11/1996 | Kublak et al. | 378/119 |
| 5,637,962 | 6/1997 | Prono et al. | 315/111.2 |

FOREIGN PATENT DOCUMENTS 610 24135 1/1986 Japan .

OTHER PUBLICATIONS

McGeoch, M., "Radio–frequency–preionized xenon Z–pinch source for extreme ultraviolet lithography". Applied Optics, vol. 37, No. 9, Mar. 20, 1998, pp. 1651–1658.

*Primary Examiner*—David P. Porta

*Attorney, Agent, or Firm*—Wolf, Greenfield & Sacks, P.C.

[57] ABSTRACT

A plasma x-ray source includes a chamber defining a pinch region having a central axis, a gas supply for introducing a gas mixture into the pinch region, a preionizing device disposed around the pinch region for preionizing the gas mixture in the pinch region, and a pinch anode and a pinch cathode disposed at opposite ends of the pinch region. The gas mixture includes a primary X-radiating gas, such as xenon, and a low atomic number diluent gas, such as helium. The pinch anode and the pinch cathode produce a current through the plasma shell in an axial direction and produce an azimuthal magnetic field in the pinch region in response to application of a high energy electrical pulse to the pinch anode and the pinch cathode. The azimuthal magnetic field causes the plasma shell to collapse to the central axis and to generate X-rays. The gas mixture provides enhanced radiation intensity and reduced cost for the primary X-radiating gas.

21 Claims, 3 Drawing Sheets

Z-PINCH SOFT X-RAY SOURCE USING DILUENT GAS

FIELD OF THE INVENTION

This invention relates to a plasma X-ray source of the Z-pinch type and, more particularly, to an X-ray source that utilizes a gas mixture including a primary X-radiating gas and a low atomic number diluent gas for improved axial radiation intensity and reduced cost.

BACKGROUND OF THE INVENTION

A Z-pinch plasma X-ray source that utilizes the collapse of a precisely controlled, low density plasma shell to produce intense pulses of soft X-rays is disclosed in U.S. Pat. No. 5,504,795 issued Apr. 2, 1996 to McGeoch. The X-ray source includes a chamber defining a pinch region having a central axis, an RF electrode disposed around the pinch region for pre-ionizing the gas in the pinch region to form a plasma shell that is symmetrical around the central axis in response to application of RF energy to the RF electrode, and a pinch anode and a cathode disposed at opposite ends of the pinch region. An X-radiating gas is introduced into the chamber at a typical pressure level between 0.1 torr and 10 torr. The pinch anode and the pinch cathode produce a current through the plasma shell in an axial direction and produce an azimuthal magnetic field in the pinch region in response to application of a high energy electrical pulse to the pinch anode and the pinch cathode. The azimuthal magnetic field causes the plasma shell to collapse to the central axis and to generate X-rays.

X-ray measurements using different gases and gas mixtures in the disclosed x-ray source have shown that there is often more radiation intensity in directions close to the pinch axis than in the more radial directions. In the rapidly recombining plasma that exists within a few tens of nanoseconds after the pinch has reached peak density and temperature, the radiation field of emitted X-rays is converging on the Planck equilibrium distribution for a plasma at the recombination temperature. However, in such high aspect ratio plasmas, (aspect ratios, defined as length divided by diameter, of between 50 and 100 are typical in this device), it often happens that the radiation field cannot reach equilibrium in non-axial directions due to the limited optical depth of the plasma in these directions. As a consequence, it appears that the equilibrium intensity in the axial direction is able to overshoot the Planck value. This Planckian overshoot factor has been measured to exceed 6 for radiation at the wavelength of 100 angstroms in the case of the recombination of lithium-like oxygen (O VI).

A method for exciting the 134 angstrom xenon band of interest for lithography, using laser excitation of xenon clusters in a high pressure expansion, is disclosed in U.S. Pat. No. 5,577,092 issued Nov. 19, 1996 to Kubiak et al. The disclosed method uses a continuous flow of xenon, accompanied by other gases, through a nozzle, and results in substantial xenon usage. An XUV radiation source, based on the electron beam excitation of a xenon gas jet, that is stated to be useful in lithography applications is disclosed in U.S. Pat. No. 5,637,962 issued Jun. 10, 1997 to Prono et al.

It is desirable to provide plasma X-ray sources and methods of operating such sources which produce increased radiation intensity and reduced operating costs in comparison with prior art X-ray sources.

SUMMARY OF THE INVENTION

According to a first aspect of the invention, a plasma X-ray source is provided. The plasma X-ray source comprises a chamber defining a pinch region having a central axis, a gas supply for introducing a gas mixture into the pinch region, a device disposed in proximity to the pinch region for preionizing the gas mixture in the pinch region, and a pinch anode and a pinch cathode disposed at opposite ends of the pinch region. The gas mixture comprises a primary X-radiating gas and a low atomic number diluent gas. The pinch anode and the pinch cathode produce a current through the plasma shell in an axial direction and produce an azimuthal magnetic field in the pinch region in response to application of a high energy electrical pulse to the pinch anode and the pinch cathode. The azimuthal magnetic field causes the plasma shell to collapse to the central axis and to generate X-rays.

The diluent gas may be selected from the group consisting of helium, hydrogen, deuterium, nitrogen and combinations thereof. The primary X-radiating gas may be selected from the group consisting of xenon, argon, krypton, neon and oxygen, but is not limited to this group. The gas mixture preferably has a total pressure in the pinch region in a range of about 0.1 torr to 1.0 torr.

In one embodiment, the primary X-radiating gas is xenon for generation of 134 angstrom xenon band radiation and the diluent gas is helium. Radiation intensity enhancements of between 20% and 40% relative to the use of undiluted xenon have been achieved in this embodiment.

The preionizing device may comprise an RF electrode for preionizing the gas mixture in the pinch region in response to application of RF energy to the RF electrode. The chamber may define a substantially cylindrical pinch region. The preionizing device preferably produces an axially uniform discharge in the pinch region.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
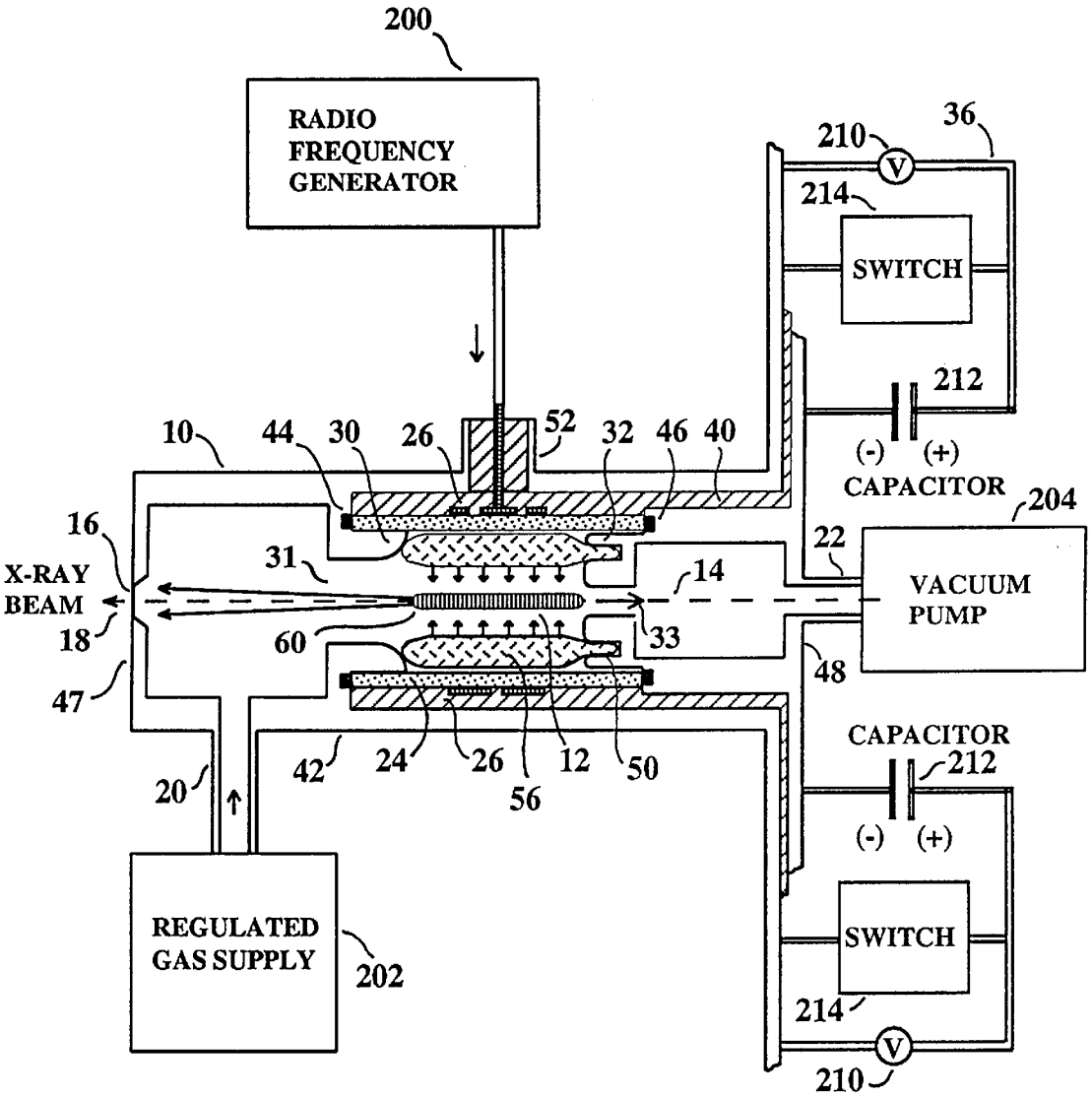
FIG. 1 is a cross sectional view of a plasma X-ray source in accordance with the invention.

An example of a plasma x-ray source in accordance with the present invention is shown in FIG. 1. An enclosed chamber 10 defines a pinch region 12 having a central axis 14. The chamber 10 may include an x-ray transmitting window 16 located on axis 14. A gas inlet 20 and a gas outlet 22 permit a gas at a prescribed pressure to be introduced into the pinch region 12. The example of FIG. 1 has a generally cylindrical pinch region 12.

A cylindrical dielectric liner 24, which can be a ceramic material, surrounds pinch region 12. An RF electrode 26 is disposed on the outside surface of dielectric liner 24. A pinch anode 30 is disposed at one end of the pinch region 12, and a pinch cathode 32 is disposed at the opposite end of pinch region 12. The portion of pinch anode 30 adjacent to pinch region 12 has an annular configuration disposed on the inside surface of the dielectric liner 24. Similarly, the portion of cathode 32 adjacent to pinch region 12 has an annular configuration inside dielectric liner 24 and spaced from dielectric liner 24. In a preferred embodiment, the pinch cathode 32 includes an annular groove 50 which controls the location at which the plasma shell attaches to cathode 32. Preferably, the anode 30 has an axial hole 31, and the cathode 32 has an axial hole 33 to prevent vaporization by the collapsed plasma, as described below. The anode 30 and the cathode 32 are connected to an electrical drive circuit 36 and are separated by an insulator 40. The anode 30 is connected through a cylindrical conductor 42 to the drive circuit 36. The cylindrical conductor 42 surrounds pinch region 12. As described below, a high current pulse through cylindrical conductor 42 contributes to an azimuthal magnetic field in pinch region 12. An elastomer ring 44 is positioned between anode 30 and one end of dielectric liner 24, and an elastomer ring 46 is positioned between cathode 32 and the other end of dielectric liner 24 to ensure that the chamber 10 is sealed vacuum tight.

In the example of FIG. 1, the chamber 10 is defined by cylindrical conductor 42, an end wall 47 and an end wall 48. The cylindrical conductor 42 and end wall 47 are electrically connected to anode 30, and end wall 48 is electrically connected to cathode 32. It will be understood that different chamber configurations can be used within the scope of the invention.

The RF electrode 26 is connected through an RF power feed 52 to an RF generator 200 which supplies RF power for preionizing the gas in a cylindrical shell of pinch region 12. The RF power preferably has a power level greater than one kilowatt. In a preferred embodiment, the RF power is 5 kilowatts at 1 GHz. It will be understood that different RF frequencies and power levels can be used within the scope of the present invention. In a preferred embodiment, the RF electrode 26 comprises a center-fed spiral antenna wrapped around the dielectric liner 24, with a total angular span of +/−200°. It will be understood that different spiral configurations and different RF electrode configurations can be utilized for preionizing the gas in the pinch region 12. The spiral configuration described above has been found to provide satisfactory results.

The drive circuit 36 supplies a high energy, short duration of electrical pulse to anode 30 and cathode 32. In a preferred embodiment, the pulse is 25 kilovolts at a current of 300 kiloamps and a duration of 200–250 nanoseconds.

The inside wall of dielectric liner 24, the anode 30 and the cathode 32 define a cylinder of low density gas. RF power is applied to the RF electrode 26 to cause ionization within the gas cylinder. It is a property of the application of intense RF power to a gas surface that the ionization is concentrated in a surface layer. This is exactly what is needed to create a precise cylindrical plasma shell 56 for the subsequent passage of current. Once the gas has been preionized by RF energy, the drive circuit 36 is activated to apply a high energy electrical pulse between anode 30 and cathode 32. Typically, the RF power is applied 1–100 microseconds before the drive circuit 36 is activated. The high energy pulse causes electrons to flow from the pinch cathode 32 to the pinch anode 30. Initially, the current flows in the preionized outer layer of the gas cylinder and forms plasma shell 56. The return current flows back to the drive circuit 36 through the outer cylindrical conductor 42. An intense azimuthal magnetic field is generated between the outer current sheet through cylindrical conductor 42 and the current sheet in the plasma shell 56. The magnetic field applies a pressure which pushes the plasma shell 56 inward toward the axis 14. After approximately 200–250 nanoseconds, the drive circuit 36 is discharged and the current drops to a lower value. At approximately the same time, the plasma shell reaches the axis 14 with high velocity, where its motion is arrested by collisions with the incoming plasma shell from the opposite radial direction. The result of this stagnation process is the conversion of kinetic energy into heat, which further ionizes the gas into high ionization states that radiate x-rays strongly in all directions. In the case of population inversion on an x-ray transition and in cases when the plasma is optically dense in the axial direction but optically thin in radial directions, the radiation is concentrated in the two axial directions via amplified spontaneous emission. Thus with reference to FIG. 1, the plasma shell 56 collapses to form a collapsed plasma 60 on axis 14 in approximately 200–250 nanoseconds.

RF generator 200 supplies RF energy to RF electrode 26 through RF power feed 52. The RF generator 200 may be any suitable source of the required frequency and power level. A regulated gas supply 202 is connected to gas inlet 20, and a vacuum pump 204 is connected to gas outlet 22. The gas supply 202 and the vacuum pump 204 introduce gas into pinch region 12 and control the pressure at the desired pressure level.

In drive circuit 36, multiple circuits are connected in parallel to the pinch anode 30 and the pinch cathode 32 to achieve the required current level. A preferred embodiment utilizes six to eight drive circuits connected in parallel, each generating about 20 to 40 kiloamps. As shown in FIG. 1, each drive circuit includes a voltage source 210 connected to an energy storage capacitor 212. A switch 214 is connected in parallel with storage capacitor 212. The switch 214 may comprise a multiple channel pseudospark switch as described in U.S. Pat. No. 5,502,356 issued Mar. 26, 1996 to McGeoch, which is hereby incorporated by reference. The switch 214 may also comprise a hydrogen thyratron. The switches 214 in the parallel circuits are closed simultaneously to generate a high energy pulse for application to the anode 30 and cathode 32. Additional information regarding the Z-pinch plasma X-ray source is disclosed in U.S. Pat. No. 5,504,795, which is hereby incorporated by reference.

According to the present invention, the gas introduced into the pinch region 12 is a gas mixture including a diluent gas and a primary X-ray emitting gas. The gas mixture renders radiating transitions of the primary gas optically thin in directions other than axial, thereby enhancing the axial radiation intensity that is achievable during recombination. Typically, the diluent gas is a substantial fraction of the gas mixture introduced into the pinch region prior to electrical excitation of the source. Because a smaller volume of the relatively expensive primary X-radiating gas is used, the cost of operating the X-ray source is reduced.

The diluent gas should have low atomic number (preferably less than Z=8) in order to completely ionize without requiring too great an energy input, which would otherwise detract from the energy available for ionization of the primary radiating gas. The diluent gas typically can be, but is not limited to, helium, hydrogen, deuterium, nitrogen and combinations thereof. An example of the invention is the enhanced Z-pinch axial emission of xenon in the 134 angstrom band useful for lithography using helium as the diluent gas.

Figure 2:
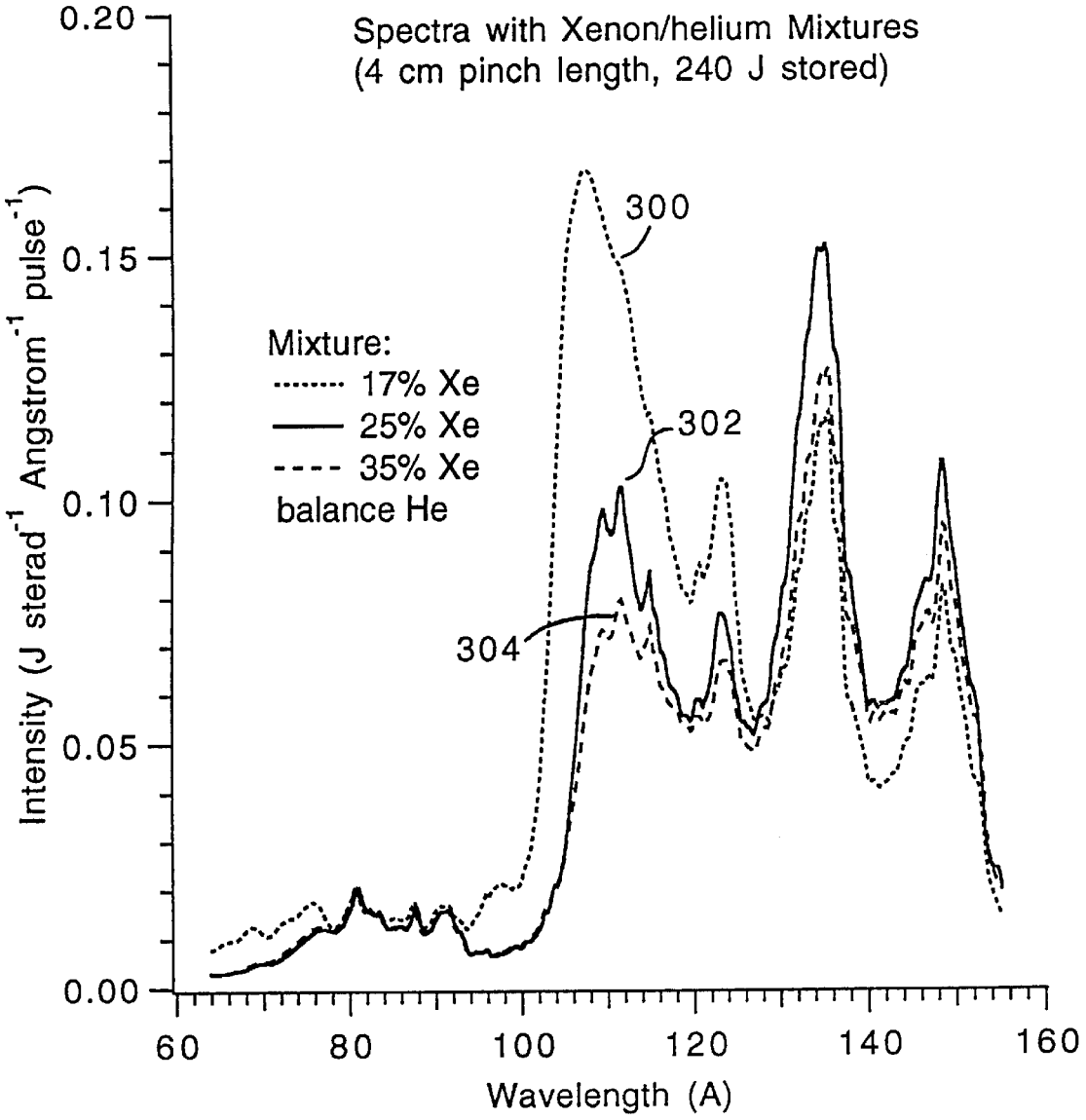
FIG. 2 is a graph of radiation intensity of the X-ray source as a function of wavelength for different xenon/helium mixtures.

Data from a 4 centimeter long Z-pinch region indicates an approximate 40% increase in the xenon band axial intensity at 134 angstroms as the helium diluent fraction is increased from 0% to 75% of a helium-xenon mixture. The typical evolution of the xenon band spectrum with helium dilution is shown in FIG. 2, with a spectral range from 100 angstroms to 150 angstroms as shown. Curves 300, 302 and 304 represent xenon percentages of 17%, 25% and 35%, respectively, in the gas mixture, with the balance being helium. In FIG. 2, the total gas density in the pinch region has been adjusted in each case to yield optimum spectral intensity at 134 angstroms.

Figure 3:
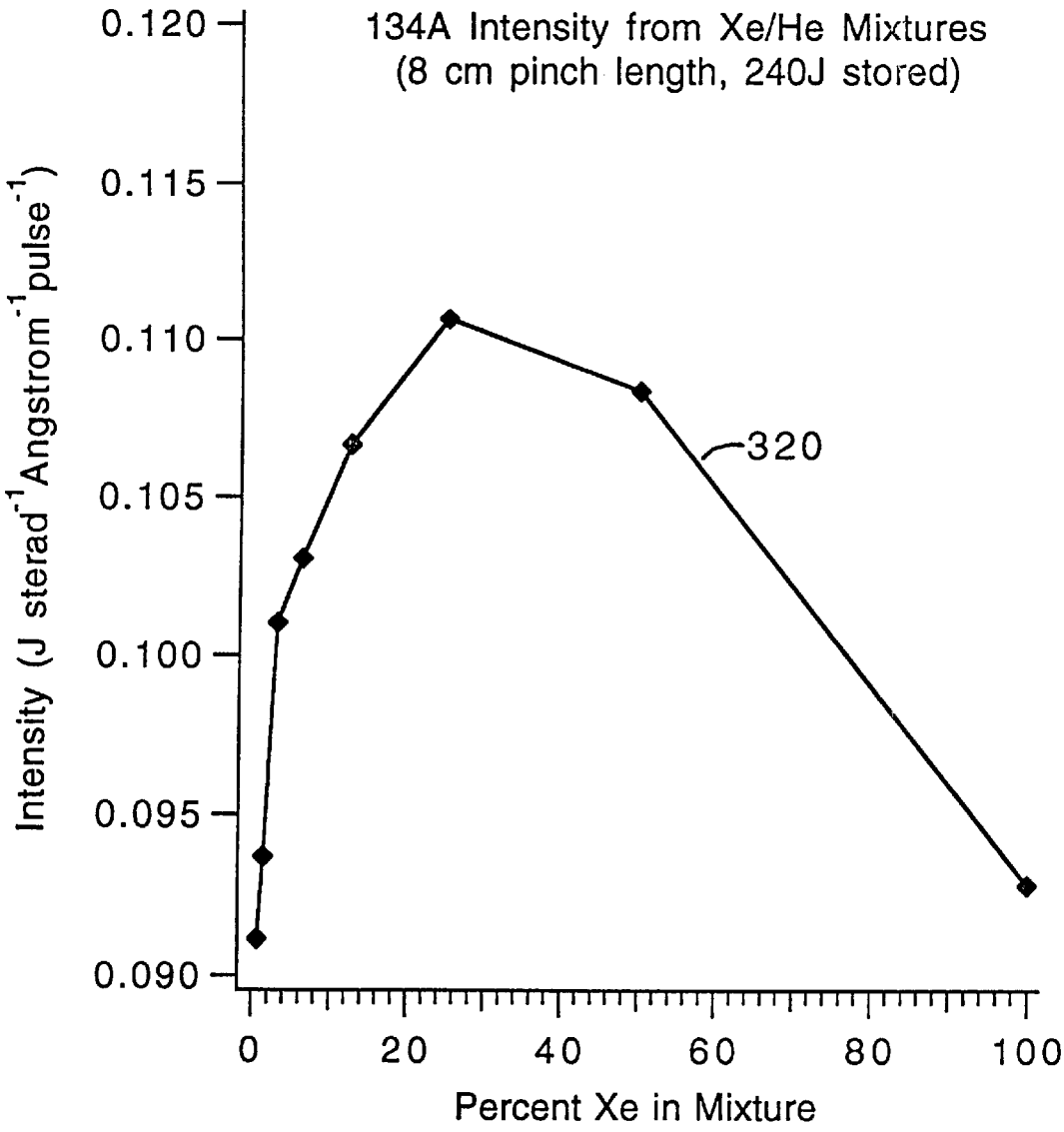
FIG. 3 is a graph of radiation intensity of the X-ray source as a function of percent xenon in the gas mixture.

A corresponding set of data from an 8 centimeter Z-pinch region is shown as curve 320 in FIG. 3. Although the enhancement with dilution appears to be less for the longer pinch, it amounts to a 20% increase, with the optimum again being observed for the 25% Xe/75% He mixture.

It has also been shown that both hydrogen and nitrogen can be substituted for helium with very little change in axial radiation efficiency. It is presumed that deuterium would perform in a similar manner.

The use of helium as a diluent is preferred over more chemically active elements, such as hydrogen or nitrogen, in order to give the source maximum compatibility with user systems that might be exposed to low concentrations of the pinch gas mixture at remote locations down an evacuated X-ray beamline.

Very low xenon concentrations can be employed in helium diluent with little loss of efficiency. FIG. 3 shows that as little as 0.7% Xe in helium will yield 80% of the intensity that occurs with 25% Xe in helium. This circumstance allows very efficient photon production per flowing xenon atom, although it is to be noted that approximately two times the total gas pressure is required for the lowest xenon cases, in order to optimize the spectral intensity in the band at 134 angstroms.

The primary X-radiating gas contained within pinch region 12 can be any gas having suitable transitions for X-ray generation. Examples include, but are not limited to xenon, argon, krypton, neon and oxygen. The total gas pressure is selected to give high enough gas density to ensure a high collision rate as the gas stagnates on the axis, but not so high a density that the motion is slow and the incoming kinetic energy is too low to create the high temperature for needed for X-ray emission. Typically, the total gas pressure of the X-radiating gas and the diluent gas is in a range of about 0.1 torr to 1.0 torr. Gas may be caused to flow through pinch region 12 continuously or may be pulsed with a relatively long time constant. The pressure in the pinch region 12 should be substantially uniform when the high current electrical pulse is applied to the source. As described above, a higher total gas pressure is required when the primary X-radiating gas is a small fraction of the gas mixture.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A plasma X-ray source comprising:

a chamber defining a pinch region having a central axis;

a gas supply for introducing a gas mixture, comprising a primary X-radiating gas and a low atomic number diluent gas, into said pinch region;

a preionizing device disposed in proximity to said pinch region for preionizing the gas mixture in said pinch region to form a plasma shell that is symmetrical around said central axis; and a pinch anode and a pinch cathode disposed at opposite ends of said pinch region for producing a current through said plasma shell in an axial direction and for producing an azimuthal magnetic field in said pinch region in response to application of a high energy electrical pulse to said pinch anode and said pinch cathode, whereby said azimuthal magnetic field causes said plasma shell to collapse to said central axis and to generate X-rays in a spectral range from 100 angstroms to 150 angstroms.

2. A plasma X-ray source as defined in claim 1 wherein said diluent gas is selected from the group consisting of helium, hydrogen, deuterium, nitrogen and combinations thereof.

3. A plasma X-ray source as defined in claim 1 wherein said primary X-radiating gas is selected from the group consisting of xenon, argon, krypton, neon and oxygen.

4. A plasma X-ray source as defined in claim 1 wherein said primary X-radiating gas comprises xenon for generation of 134 angstrom xenon band radiation.

5. A plasma X-ray source as defined in claim 4 wherein said diluent gas comprises helium.

6. A plasma X-ray source as defined in claim 5 wherein said gas mixture comprises at least about 0.7% xenon.

7. A plasma X-ray source as defined in claim 1 wherein said gas mixture has substantially uniform pressure within said pinch region when said high energy electrical pulse is applied to said pinch anode and said pinch cathode.

8. A plasma X-ray source as defined in claim 1 wherein said gas mixture has a total pressure in said pinch region in a range of about 0.1 torr to 1.0 torr.

9. A plasma X-ray source as defined in claim 1 wherein said preionizing device comprises an RF electrode for preionizing the gas mixture in said pinch region in response to application of RF energy to said RF electrode.

10. A plasma X-ray source as defined in claim 1 wherein said chamber defines a substantially cylindrical pinch region.

11. A plasma X-ray source as defined in claim 1 wherein said preionizing device produces an axially uniform discharge in said pinch region.

12. A plasma X-ray source comprising:

a chamber defining a pinch region having a central axis, said pinch region being substantially uniform along said central axis;

a gas supply coupled to said chamber for introducing a gas mixture comprising a primary X-radiating gas and a low atomic number diluent gas into said pinch region;

an RF electrode disposed around said pinch region for pre-ionizing the gas mixture in said pinch region to form a plasma shell that is symmetrical around said central axis in response to application of RF energy to said RF electrode; and a pinch anode and a pinch cathode disposed at opposite ends of said pinch region for producing a current through said plasma shell in an axial direction and for producing an azimuthal magnetic field in said pinch region in response to application of a high energy electrical pulse to said pinch anode and pinch cathode, whereby said azimuthal magnetic field causes said plasma shell to collapse to said central axis and to generate X-rays in a spectral range from 100 angstroms to 150 angstroms.

13. A plasma X-ray source as defined in claim 12 wherein said primary X-radiating gas comprises xenon for generation of 134 angstrom xenon band radiation.

14. A plasma X-ray source as defined in claim 13 wherein said diluent gas comprises helium.

15. A plasma X-ray source as defined in claim 12 wherein said gas mixture has a total pressure in said pinch region in a range of about 0.1 torr to 1.0 torr.

16. A plasma X-ray source as defined in claim 12 wherein said pinch region is substantially cylindrical.

17. In a plasma X-ray source comprising a chamber defining a pinch region having a central axis, a method for generating X-rays comprising the steps of:

introducing a gas mixture comprising a primary X-radiating gas and a low atomic number diluent gas into said pinch region;

preionizing the gas mixture in the pinch region to form a plasma shell that is symmetrical around the central axis; and producing a current through said plasma in an axial direction and producing an azimuthal magnetic field in said pinch region, whereby said azimuthal magnetic field causes said plasma shell to collapse to said central axis and to generate X-rays in a spectral range from 100 angstroms to 150 angstroms.

18. A method as defined in claim 17 wherein the step of introducing a gas mixture comprises introducing xenon as the primary X-radiating gas for a generation of 134 angstrom xenon band radiation.

19. A method as defined in claim 18 wherein the step of introducing a gas mixture further comprises introducing helium as the diluent gas.

20. A method as defined in claim 19 wherein the step of introducing a gas mixture further comprises the step of controlling the total pressure of said gas mixture in said pinch region in a range of about 0.1 torr to 1.0 torr.

21. A plasma X-ray source comprising:

a chamber defining a pinch region having a central axis;

a gas supply for introducing a gas mixture, comprising a primary X-radiating gas and a low atomic number diluent gas, into said pinch region;

a preionizing device disposed in proximity to said pinch region for preionizing the gas mixture in said pinch region to form a plasma shell that is symmetrical around said central axis; and a pinch anode and a pinch cathode disposed at opposite ends of said pinch region for producing a current through said plasma shell in an axial direction and for producing an azimuthal magnetic field in said pinch region in response to application of a high energy electrical pulse to said pinch anode and said pinch cathode, whereby said azimuthal magnetic field causes said plasma shell to collapse to said central axis and to generate X-rays, wherein said primary X-radiating gas comprises xenon for generation of 134 angstrom xenon band radiation and wherein said diluent gas comprises helium.

* * * * *